US005752684A

United States Patent [19]

Larkin

[11] Patent Number: 5,752,684

[45] Date of Patent: May 19, 1998

[54] PEDESTAL CHAIR BASE

[75] Inventor: Robert F. Larkin, High Point, N.C.

[73] Assignee: Miller Desk, Inc., High Point, N.C.

[21] Appl. No.: 275,018

[22] Filed: Jul. 13, 1994

[51] Int. Cl.[6] ..... A47B 91/00

[52] U.S. Cl. ..... 248/188.7; 248/188.1; 248/519

[58] Field of Search ..... 248/188.1, 188.7, 248/188.8, 519

[56] References Cited

U.S. PATENT DOCUMENTS

| | | | |
|---|---|---|---|
| 2,992,803 | 7/1961 | Good | 248/188.7 |
| 3,160,382 | 12/1964 | Lee | 248/188.7 |
| 3,281,105 | 10/1966 | Kafferlin et al. | 248/188.7 |
| 3,499,625 | 3/1970 | Froedge | 248/188.7 |
| 3,617,023 | 11/1971 | Schneiderman | 248/188.7 |
| 3,682,425 | 8/1972 | Vincent et al. | 248/188.7 |
| 3,705,704 | 12/1972 | Textoris | 248/188.7 |
| 3,838,838 | 10/1974 | Seaman, Jr. | 248/188.7 X |
| 4,821,986 | 4/1989 | White | 248/188.7 |
| 5,137,237 | 8/1992 | Haskins | 248/188.7 |
| 5,149,035 | 9/1992 | Bonnema et al. | 248/188.7 |

FOREIGN PATENT DOCUMENTS

| | | | |
|---|---|---|---|
| 822980 | 9/1969 | Canada | 248/188.7 |
| 2215991 | 10/1973 | Germany | 248/188.7 |

*Primary Examiner*—Ramon O. Ramirez
*Assistant Examiner*—Derek J. Berger
*Attorney, Agent, or Firm*—Brian D. Voyce

[57] ABSTRACT

The present invention relates to a pedestal base for a chair that is capable of supporting safely up to a 500 pound person in normal, continuous commercial or industrial use. The present pedestal base has six legs, a substantially cylindrical hub, and six caster attachment means with a caster or glide in each caster attachment means. Each leg is separated from its neighboring legs by about 60 degrees. The base elements are selected within particular dimensions and are made from materials having minimum selected yield strengths. In particular, the pedestal chair base as a whole can pass BIFMA test No. 8 with a 5000 lb load being applied, instead of a 2500 lb load, and can pass BIFMA tests No. 9 and No. 18, each with a 500 lb load being used instead of a 300 lb load.

29 Claims, 6 Drawing Sheets

PEDESTAL CHAIR BASE

TECHNICAL FIELD

The present invention relates to a pedestal base for a chair that is capable of safely supporting up to a 500 pound person in normal, continuous commercial or industrial use. Not only does the present pedestal chair base satisfy the rigid industrial standards of relevant ANSI/BIFMA tests, but it far surpasses these standards. Moreover, the present chair base does so in an economical manner that fits within current design restrictions.

BACKGROUND ART

A chair manufacturer must design and build all parts of a chair in keeping with rigid stress tests. The Bureau of the Industrial Furniture Manufacturers Association (BIFMA) is a business and institutional manufacturers' association. In cooperation with the American National Standards Institute, Inc. (ANSI), BIFMA has established a set of standards to provide recommended safety levels. Current standards are set forth in BIFMA publications BIFMA X5.1 1985 and ANSI/BIFMA 1993. Typically, a pedestal base chair has to satisfy over ten BIFMA tests. These test apply to any pedestal chair base, be it cast, welded, or molded from a metal, alloy, plastic, or composite.

Pedestal chair bases have to be concerned, in particular, with three BIFMA tests. The first is BIFMA test No. 8, a static load test. The purpose of Test No. 8 is to evaluate the ability of a pedestal base to withstand stresses such as those caused by shock loads applied to the chair seat or by dropping the chair to the floor. Pins are placed in each nib of the pedestal base, the hub of the base being unsupported. For one minute, a 2500 lbf is applied downwardly on the hub. The pedestal chair base must withstand the load without permanent deflection or breakage. In any event, no failure must occur which would cause personal injury to the occupant. In the prior art, cast metal or alloy pedestal chair bases typically can withstand a load of from 2200 lbs to 3200 lbs, depending upon how it is cast and what metal or alloy is used. Prior pedestal chair bases made from welded steel withstand a load of from 2550 lbs to 3400 lbs. Finally, molded nylon pedestal chair bases passed loads of from 2500 lbs to 3300 lbs.

The second BIFMA test of particular relevance to pedestal chair bases is No. 9, the seating impact or drop test. The purpose of Test No. 9 is to evaluate the ability of a pedestal base to withstand the stresses and dynamic forces of a user's collapsing into a chair with their full weight. A 300 lb load is dropped 6 inches into the seat of a pedestal chair, including the chair base. While conventional cast, welded or molded pedestal chair bases could pass a drop of 300 lbs, all fail a drop of 500 lbs.

The third BIFMA test is test No. 18, the caster and chair base durability test. The purpose of this test is to evaluate the ability of the base and casters to withstand fatigue stresses and such as that caused by a user's moving back and forth while maintaining caster retention. In Test No. 18, a 300 lb load is placed on the seat of a pedestal chair. The base, including casters, is rolled back and forth over defined and strategically placed obstructions. Made of flat steel plate, these obstructions are ⅛ inches high, and 2 inches long by 12 inches wide. The pedestal chair is rolled back and forth over the obstructions for 100,000 cycles if the casters have hard treads or 36,000 cycles if the casters have soft treads. None of the conventional pedestal chair bases can pass Test No. 18 if a 500 lb load is placed in the chair seat.

Currently, there are no pedestal chair bases being made which safely support a 500 pound person under normal, continuous commercial or industrial use.

SUMMARY OF THE INVENTION

The present invention relates to a pedestal base for a chair capable of safely supporting up to a 500 pound person. For the purposes of the present invention, the term "safely supporting" includes meaning that a pedestal chair base passes BIFMA test No. 8 with a 5000 lb load being applied, (preferably a 6500 lb load), instead of a 2500 lb load. It also means that a pedestal chair base passes BIFMA tests No. 9 and No. 18, each with a 500 lb load being used instead of a 300 lb load.

The present pedestal chair base comprises the elements of a hub, six legs, and six caster attachment means, optionally including caster means or glide means. For the purposes of the present invention, the attachments of one component of the pedestal chair base to another, such as hub to leg, can include either welding, being cast as a unitary piece, or fastening or attaching techniques known to those of ordinary skill in the art. The pedestal chair base and its individual elements can be made from a number of conventional materials known to the art, including metals, alloys, plastics, or composites. For example, suitable metals or alloys include low and medium carbon steels, aluminum, aluminum alloys, stainless steels. Suitable plastics or composites include graphite composites, such as Kevlar™ type composites, reinforced nylon such as Zytel, glass-filled polyester such as Rynyte, glass-filled polyurethane, reinforced fiberglass, ™, (all marks are to materials made by DuPont de Nemours Co. of Wilmington, Del.)

The hub has an opening dimensioned and configured to receive a conventional seat control means or seat support means. Such means are known by those ordinarily skilled in the art. Typically, the hub is substantially cylindrical. The hub is made from a material or composite having a yield strength of at least 20,000 psi at 68 degrees Fahrenheit. With some materials, such as low carbon steels, the ultimate strength of the material will exceed the yield strength by over 20%, however, with some composites, for example, reinforced nylons, the yield strength and ultimate strength are essentially the same. (For the purposes of the present invention, the terms "ultimate strength" or "yield strength" are defined as set forth by ANSI/SAE standards, referring to tensile and compressive forces.)

Six legs radiate from the hub, each leg being separated from its neighboring legs by about 60 degrees. The legs, as dimensioned and configured, are made from a material or composite, having a yield strength of at least 20,000 psi at 68 degrees Fahrenheit. Each leg is attached to the hub at the proximal end such that the plane or axis of the height of each leg is parallel to the axis defined by the hub opening. The length of each leg is from 8 inches to 16 inches, creating a pedestal chair base diameter of from 20 inches to 34 inches. In practice, each leg has a width of less than 4 inches and a height of from about 1 inch to 3 inches. The legs may have any conventional cross-sectional shape, including being shaped as a bar, tube, or rod.

Finally, attached to the distal end of each leg is a caster attachment means of conventional design, such as a caster nib or caster stem. Each caster attachment means is made of a material or composite having a yield strength of at least 20,000 psi at 68 degrees Fahrenheit. The caster attachment means is dimensioned and configured either to receive or to be received by a caster means or a glide means. For the purposes of the present invention, attachment to the distal end of the leg includes attaching to the sides of the legs as well as to the end (as shown in the Figures). If the caster attachment means is a nib, then each nib has an opening dimensioned and configured to receive a conventional caster means or a glide means. The nibs are oriented such that the axis of the nib opening is parallel to the axis of the hub opening. If the caster attachment means is a stem, then each stem has an shaft dimensioned and configured to be received by a conventional caster means or a glide means. The stems are oriented such that the axis of the stem shaft is parallel to the axis of the hub opening.

The sectional modulus of the hub, each leg, and each caster attachment means are dimensioned and configured such that the pedestal chair base, as a whole, can withstand the torsional loads, shear forces, compression forces, and tension forces, with sufficient fatigue resistance, so as to pass BIFMA test No. 8 with a 5000 lb load being applied, instead of a 2500 lb load, and so as to pass BIFMA tests No. 9 and No. 18, each with a 500 lb load being used instead of a 300 lb load. One of ordinary skill in the art realizes that by selecting materials or composites having stronger mechanical properties, one can decrease the dimensions or shapes of the sectional modulus of the pedestal chair base elements.

Optionally, a conventional caster means, (i.e., a ball caster, a single wheel caster, or a dual wheel caster), or a glide means can be attached to each caster attachment means. The caster means or the glide means is dimensioned and configured to withstand a rolling load of no greater than 95 lbs. (For purposes of the present invention, "rolling load" refers to the effort required to move the chair when loaded.) Also, the caster means or the glide means is dimensioned and configured to withstand a working load of at least 100 lbs. (For the purposes of the present invention, "working load" refers to the weight capacity of each individual caster.)

Not only does the present pedestal chair base satisfy the rigid industrial standards of relevant BIFMA tests modified with the increased forces or loads that represent the stress of normal, continuous usage by up to a 500 lb person, but it also does so in an economical manner that fits within current design restrictions for office or industrial furniture.

PREFERRED EMBODIMENTS

Figure 1:
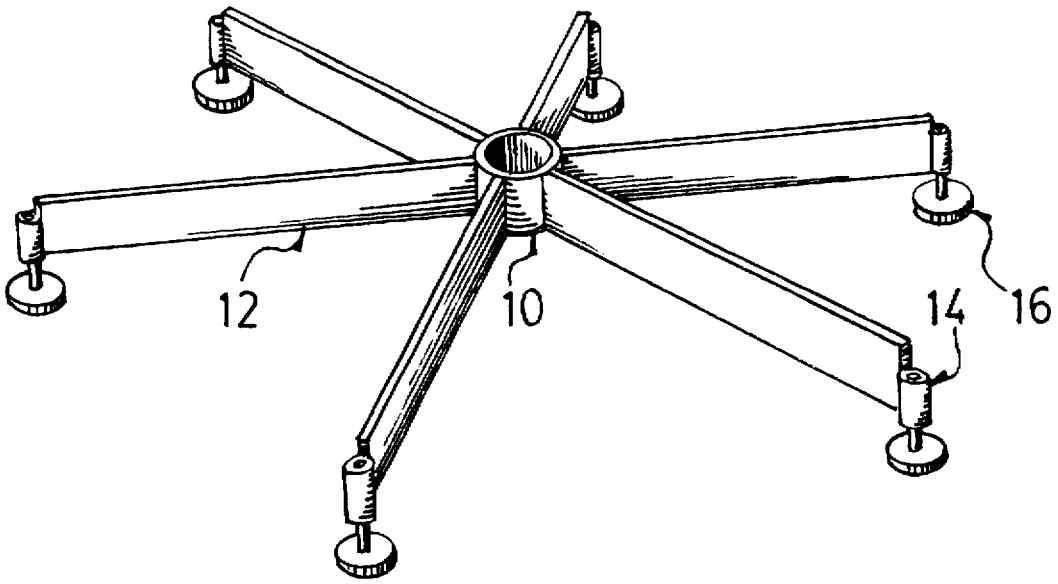
FIG. 1 is a perspective view of a preferred mode of the claimed pedestal chair base that receives a gas cylinder control or support means.

Generally, in preferred embodiments, the elements of the present pedestal chair base can be more restrictively defined. The hub is made from a material or composite having a yield strength of at least 25,000 psi, more preferably at least 30,000 psi, and most preferably at least 40,000 psi. If the material or composite has a higher ultimate or tensile strength, then an ultimate strength of at least 30,000 psi is preferred, more preferably at least 40,000 psi, and most preferably at least 50,000 psi. Typically, the hub has a height of from 1 inch to 12 inches. Wall thickness varies from ⅛ inch to ½ inch. The leg is made from a material or composite having a yield strength of at least 25,000 psi, more preferably at least 30,000 psi, and most preferably at least 40,000 psi. If the material or composite has a higher ultimate or tensile strength, then an ultimate strength of at least 30,000 psi is preferred, more preferably at least 40,000 psi, and most preferably at least 50,000 psi. The leg length is from 10 inches to 14 inches, more preferably from 12 inches to 13 inches. The leg width is less than 2 inches, more preferably less than 1 inch, and most preferably less than ½ inch. The leg height is from 1 inch to 2½ inches, more preferably from 1½ inches to 2¼ inches. Finally, each caster attachment means is made from a material or composite having a yield strength of at least 25,000 psi, more preferably at least 30,000 psi, and most preferably at least 40,000 psi. If the material or composite has a higher ultimate or tensile strength, then an ultimate strength of at least 30,000 psi is preferred, more preferably at least 40,000 psi, and most preferably at least 50,000 psi. If the caster attachment means is a nib, then, preferably each nib has an opening dimensioned and configured to receive a conventional caster means or a glide means. Typically, the nib has a height of from 1 inch to 2 inches. Wall thickness varies from ⅛ inch to ½ inch. The nibs are oriented such that the axis of the nib opening is parallel to the axis of the hub opening. If the caster attachment means is a stem, then preferably, each stem has an shaft dimensioned and configured to be received by a conventional caster means or a glide means. The stems are oriented such that the axis of the stem shaft is parallel to the axis of the hub opening.

In some preferred embodiments, of the pedestal chair bases described above, the hub can be additionally strengthened by adding as an element, a reinforcing annulus to the bottom of the hub. The annulus is comprised of a material or composite that has a yield strength of at least 25,000 psi, more preferably at least 30,000 psi, and most preferably at least 40,000 psi. If the material or composite has a higher ultimate or tensile strength, then an ultimate strength of at least 30,000 psi is preferred, more preferably at least 40,000 psi, and most preferably at least 50,000 psi. (Carbon steels are particularly suitable for the annulus, preferably having at least 8% carbon.) The annulus can be dimensioned and configured to have an opening that is concentric with the hub opening, to have a width of between ¼ inch and 2 inches, and to have a thickness of at least 3/16 inch, preferably between ¼ inch and ½ inch. The annulus can extend beyond the outside diameter of the hub so as to provide an outside shoulder, typically extending from ½ inch to 2½ inches. Moreover, the annulus can be dimensioned and configured to be concentric with the axis of the hub opening and be attached to each of the legs. For example, the annulus can have a have a width of between ¼ inch and 2 inches, to have an outside diameter of between 3 inches and 12 inches, and to have a thickness of at least 3/16 inch, preferably between ¼ inch and ½ inch.

With respect to each caster means or glide means, in preferred embodiments, the rolling load can be decreased to no greater than 80 lbs, more preferably 125 lbs. The working load can be increased to 150 lbs, more preferably 165 lbs. In some preferred embodiments the rolling diameter of the caster is at least 1 inch, more preferably at least 2 inches.

Preferred metals or alloys include low carbon steels, medium carbon steel, hot drawn or cold-rolled, in particular, ANSI SAE grades C1008, C1010, C1012, C1015, C1020, or A36. If smaller dimensioned elements are preferred, then one can select from higher strength materials such as manganese steels, molybdenum steels, stainless steels, or chromium steels. Of course, the sectional modulus of the hub, each leg, and each caster attachment means are dimensioned and configured such that the pedestal chair base, as a whole, can withstand the torsional loads, shear forces, compression forces, and tension forces, with sufficient fatigue resistance, so as to pass BIFMA test No. 8 with a 5000 lb load being applied, instead of a 2500 lb load, and so as to pass BIFMA tests No. 9 and No. 18, each with a 500 lb load being used instead of a 300 lb load.

Welded Pedestal Chair Base

Figure 2:
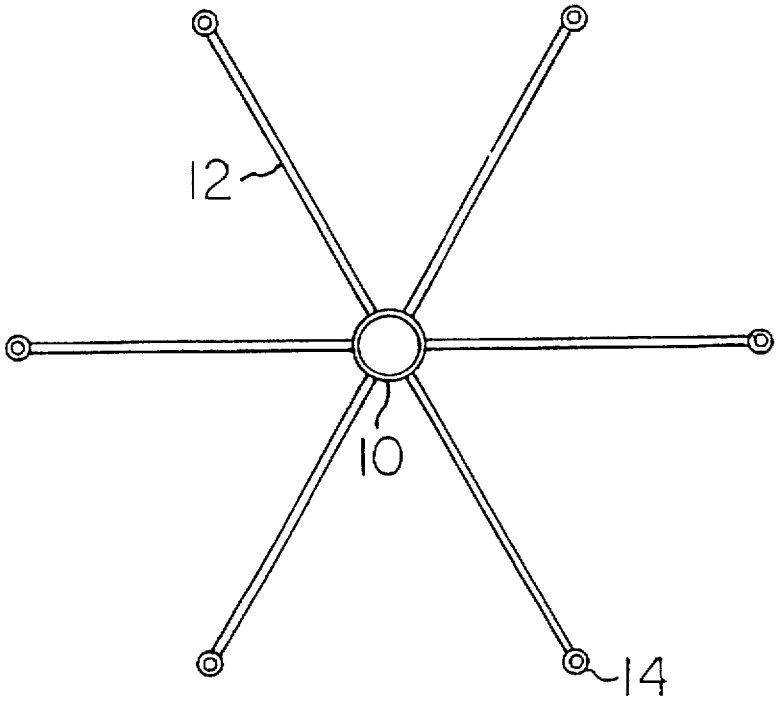
FIG. 2 is an overhead view of the preferred mode of the claimed pedestal hair base in FIG. 1.
Figure 3:
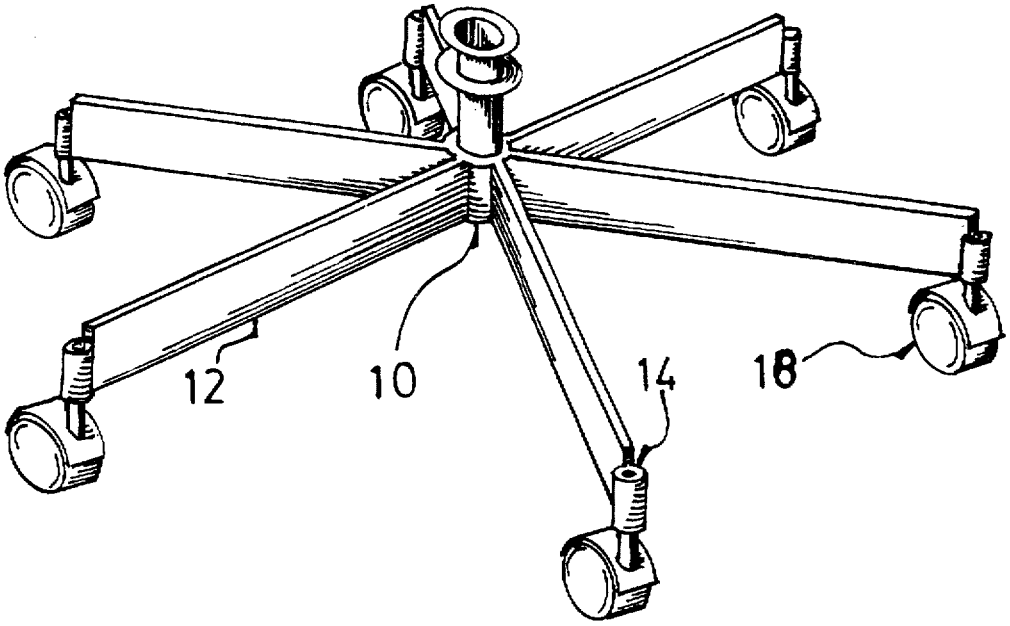
FIG. 3 is a perspective view of a preferred mode of the claimed pedestal chair base that receives a mechanical control or support means.
Figure 4:
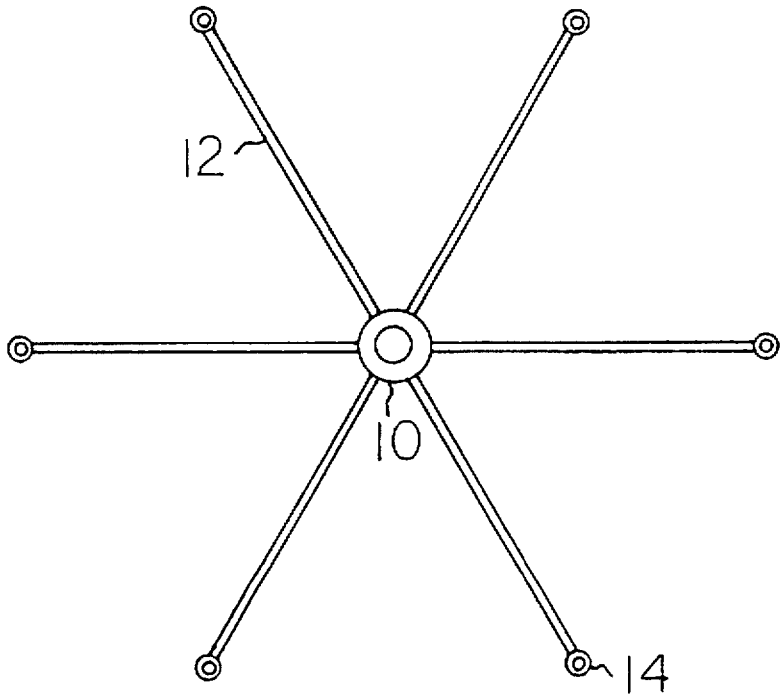
FIG. 4 is an overhead view of the preferred mode of the claimed pedestal chair base in FIG. 3.
Figure 5:
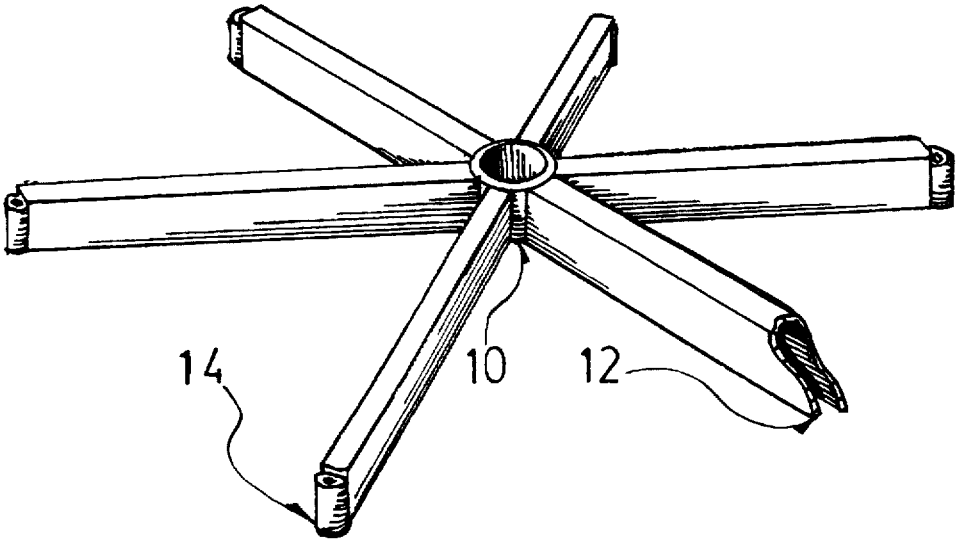
FIG. 5 is a perspective view of the claimed pedestal chair base in which the legs are of U-shaped cross-section.
Figure 6:
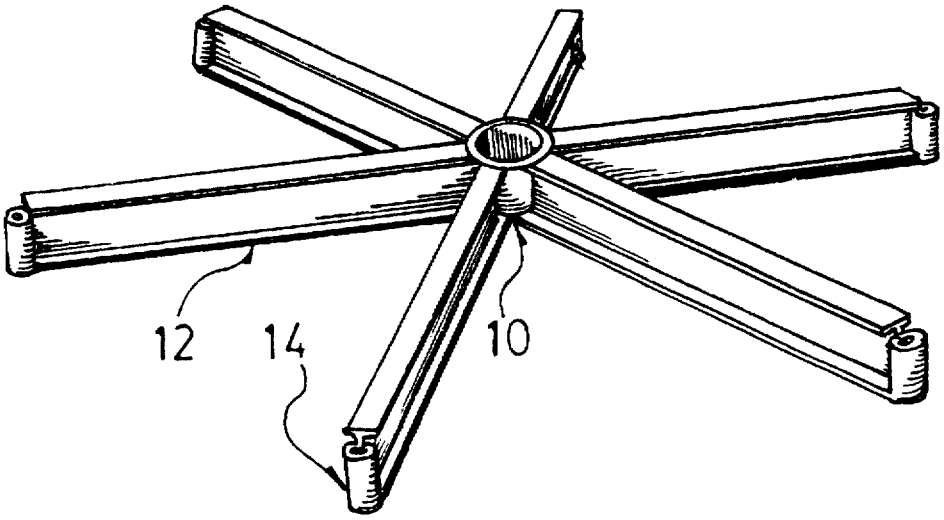
FIG. 6 is a perspective view of the claimed pedestal chair base in which the legs are of H-shaped cross-section.

In a most preferred embodiment as shown in the FIGURES, the pedestal chair base is made from welded metal or alloy. It comprises a substantially cylindrical hub (10), made of a metal or alloy having an ultimate strength of at least 55,000 psi at 68 degrees Fahrenheit and a yield strength of at least 45,000 psi at 68 degrees Fahrenheit, having an ultimate strength of at least 55,000 psi at 68 degrees Fahrenheit and a yield strength of at least 45,000 psi at 68 degrees Fahrenheit. Such materials are known to those of ordinary skill in the art. The hub has a circular opening dimensioned and configured to receive a conventional seat control means or seat support means, which are known by those skilled in the art. (FIGS. 1 and 2 illustrate a preferred pedestal chair base dimensioned and configured for using a gas cylinder control or support means, while FIGS. 3 and 4 show one dimensioned and configured for using a mechanical control or support means.) Carbon steel alloys (of at least 8% carbon) are particularly suitable and economical for hub use. A typical hub is made of SAE C1008 steel (8% carbon) annealed tubing having an outside diameter of between about 2 inches and 3 inches, a wall thickness of between 3/16 inch and 7/16 inch, and a height of between about 2 inches and 3 inches.

Six legs radiate from the hub, each leg (12) being separated from its neighboring legs by about 60 degrees. The legs are made of a metal or alloy having an ultimate strength of at least 55,000 psi at 68 degrees Fahrenheit and a yield strength of at least 45,000 psi at 68 degrees Fahrenheit. Carbon steel alloys (of at least 8% carbon) are also particularly suitable and economical for leg applications. A typical leg is made of SAE C1008 steel (8% carbon) hot rolled and pickled flat bar, having a length of between about 12 inches and 14 inches, a width or bar thickness of between about 3/16 inch and 7/16 inch, and a height of between about 1½ inches and 2½ inches. Each leg is welded to the hub at the proximal end on both sides of the leg, such that the plane or axis of the height of each leg is parallel to the axis defined by the hub opening. Instead of having a substantially rectangular cross-section, in other embodiments each leg can have a cross-sectional configuration selected from the group consisting of H bar, flat bar, I bar, or U channel.

Welded to the distal end of each leg is a substantially cylindrical nib of conventional design. Each nib (14) is made of a metal or alloy having an ultimate strength of at least 50,000 psi at 68 degrees Fahrenheit and a yield strength of at least 45,000 psi at 68 degrees Fahrenheit. Carbon steel alloys (of at least 8% carbon) are also particularly suitable and economical for leg applications. A typical nib is made of SAE C1008 steel (8% carbon) tubing or rolled flat bar. The six nibs have a circular opening dimensioned and configured to receive a conventional caster means or a glide means. The nibs are oriented such that the axis of each nib opening is parallel to the axis of the hub opening.

Optionally, a conventional caster means or glide means is releasably attached into each nib. Typically, the caster means have a rolling radius of at least 1 inch, preferably at least 1½ inches, and more preferably at least 2 inches. The caster (18) or glide (18) are dimensioned and configured to withstand a rolling load of no greater than 80 pounds and a working load of at least 165 pounds.

In a second variant of the welded pedestal chair base described above, the hub can be additionally strengthened by adding a reinforcing annulus attached to the bottom of the hub. The annulus (not shown) is comprised of a metal or alloy having an ultimate strength of at least 50,000 psi at 68 degrees Fahrenheit and a yield strength of at least 45,000 psi at 68 degrees Fahrenheit. Carbon steels are particularly suitable for the annulus, preferably having at least 8% carbon, but other metals, alloys, plastics, or composites as mentioned above are equally suitable. The annulus is dimensioned and configured to have an opening that is concentric with the hub opening and has a thickness of at least 3/16 inch, preferably between ¼ inch and ½ inch. If welded rather than fastened to the hub, the outer diameter of the annulus can extend beyond the outside diameter of the hub so as to provide an outside shoulder or support for the weld, typically extending from ½ inch to 2½ inches.

With respect to the above preferred welded embodiments, the sectional modulus of the hub, each leg, and each caster attachment means are such that the pedestal chair base, as a whole, can withstand the torsional loads, shear forces, compression forces, and tension forces, with sufficient fatigue resistance, so as to pass BIFMA test No. 8 with a 5000 lb load being applied, instead of a 2500 lb load, and so as to pass BIFMA tests No. 9 and No. 18, each with a 500 lb load being used instead of a 300 lb load.

Cast Alloy Pedestal Chair Base

Instead of welding the hub, leg, and caster attachment means components, in another preferred embodiment, these components are cast as a unitary pedestal chair base piece. Thus, using conventional metal or alloy casting techniques known to those of ordinary skill in the art, a pedestal chair base comprising hub, leg, and caster attachment means portions is cast as a unitary piece from a metal or alloy. A preferred aluminum alloy has the following composition: Al—84.10%; Si—10.00%; Cu—3.13%, Zn—1.12%; Fe—1.01%; Mg—0.23%; Mn—0.21%; and Ni—0.10%. In preferred modes of the cast pedestal chair bases, each element in the pedestal chair base has an ultimate strength of at least 55,000 psi at 68 degrees Fahrenheit and a yield strength of at least 45,000 psi at 68 degrees Fahrenheit. As in the welded version, the hub has a circular opening dimensioned and configured to receive a conventional seat control means or seat support means, which are known by those skilled in the art. Typically, the hub portion of the casting has an outside diameter of between about 2 inches and 3 inches, a wall thickness of between 3/16 inch and 7/16 inch, and a height of between about 2 inches and 3 inches.

Radiating from the hub portion of the cast pedestal chair base are six legs, each leg being separated from its neighboring legs by about 60 degrees. Typically, the leg portion of the casting has a substantially rectangular cross-section, a length of between about 12 inches and 14 inches, a width or bar thickness of between about 3/16 inch and 7/16 inch, and a height of between about 1½ inches and 2½ inches. Each leg is oriented to the hub at the proximal end such that the plane or axis of the height of each leg is parallel to the axis defined by the hub opening. Instead of having a substantially rectangular cross-section, in other embodiments each leg portion of the casting can have a cross-sectional configuration selected from the group consisting of an H, an I, a round, or a U.

At the distal end of each leg portion of the cast pedestal chair base is a substantially cylindrical nib of conventional design. Typically, each nib portion of the cast chair base has a circular opening dimensioned and configured to receive a conventional caster means or a glide means. The nibs portions are oriented such that the axis of each nib opening is parallel to the axis of the hub opening.

Finally, as with the welded versions, optionally, a conventional caster means or glide means is releasably attached into each nib portion of the cast pedestal chair base. The caster means have a rolling radius of at least 2 inches, preferably at least 2¼ inches. The caster means or glide means are dimensioned and configured to withstand a rolling load of no greater than 80 pounds and a working load of at least 165 pounds.

In a second variant of the cast pedestal chair base described above, the hub can be additionally strengthened by adding a reinforcing annulus to the bottom of the hub. The annulus can be cast or attached later, such as by welding. If cast, then obviously the annulus composition matches that of the other cast elements. If attached later, then the annulus is comprised of a material or composite that has a yield strength of at least 25,000 psi, more preferably at least 30,000 psi, and most preferably at least 40,000 psi. If the material or composite has a higher ultimate or tensile strength, then an ultimate strength of at least 30,000 psi is preferred, more preferably at least 40,000 psi, and most preferably at least 50,000 psi. The reinforcing annulus can be dimensioned and configured to have an opening that is concentric with the hub opening, to have a width of between ¼ inch and 2 inches, and to have a thickness of at least 3/16 inch, preferably between ¼ inch and ½ inch. The outside diameter of the annulus can extend beyond the outside diameter of the hub so as to provide an outside shoulder, typically extending from ½ inch to 2½ inches. Moreover, the annulus can be dimensioned and configured so as to be concentric with the axis of the hub opening and be attached to each of the legs. For example, the annulus can have a have a width of between ¼ inch and 2 inches, to have an outside diameter of between 3 inches and 12 inches, and to have a thickness of at least 3/16 inch, preferably between ¼ inch and ½ inch.

With respect to the above preferred cast embodiments, the sectional modulus of the hub, each leg, and each caster attachment means are such that the pedestal chair base, as a whole, can withstand the torsional loads, shear forces, compression forces, and tension forces, with sufficient fatigue resistance, so as to pass BIFMA test No. 8 with a 5000 lb load being applied, instead of a 2500 lb load, and so as to pass BIFMA tests No. 9 and No. 18, each with a 500 lb load being used instead of a 300 lb load.

Reinforced Nylon Pedestal Chair Base

Instead of casting the hub, leg, and caster attachment means components, in a third preferred embodiment, these components are molded as a unitary pedestal chair base piece. Thus, using conventional molding techniques known to those of ordinary skill in the art, a pedestal chair base comprising hub, leg, and caster attachments means portions is molded as a unitary piece from a plastic or composite known to those of ordinary skill in the art. Such materials include graphite composites, such as Kevlar™ type composites, reinforced nylon or nylons such as Zytel™, reinforced fiberglass, or reinforced polyester such as Rynyte™, a glass-reinforced modified polyethylene terphalate, (a thermoplastic polyester resin), reinforced from 25% to 55%. (All marks are to materials made by DuPont de Nemours Co. of Wilmington, Del.) In preferred modes of the molded pedestal chair bases each element of the pedestal chair base has a yield strength of at least 25,000 psi, more preferably at least 30,000 psi, and most preferably at least 40,000 psi. Again, as in the welded or cast versions, the hub has a circular opening dimensioned and configured to receive a conventional seat control means or seat support means, which are known by those skilled in the art. Typically, the hub portion of the molding has an outside diameter of between about 2 inches and 3 inches, a wall thickness of between 3/16 inch and 7/16 inch, and a height of between about 2 inches and 3 inches.

Radiating from the hub portion of the molded pedestal chair base are six legs, each leg being separated from its neighboring legs by about 60 degrees. Typically, the leg portion of the molding has a substantially rectangular cross-section, a length of between about 12 inches and 14 inches, a width or bar thickness of between about 3/16 inch and 7/16 inch and a height of between about 1½ inches and 2½ inches. Each leg is oriented to the hub at the proximal end such that the plane or axis of the height of each leg is parallel to the axis defined by the hub opening. Instead of having a substantially rectangular cross-section, in other embodiments each leg portion of the molding can have a cross-sectional configuration selected from the group consisting of an H, an I, a round, or a U.

At the distal end of each leg portion of the molded pedestal chair base is a substantially cylindrical nib of conventional design. Typically, each nib portion of the molded chair base has a circular opening dimensioned and configured to receive a conventional caster means or a glide means. To receive most caster means, the nib portions are oriented such that the axis of each nib opening is parallel to the axis of the hub opening, however, other orientations can be used.

As with the welded or cast versions, optionally, a conventional caster means or glide means is releasably attached into each nib portion of the molded pedestal chair base. The caster means have a rolling radius of at least 2 inches, preferably at least 2¼ inches. The caster means or glide means are dimensioned and configured to withstand a rolling load of no greater than 80 pounds and a working load of at least 165 pounds.

In a second variant of the molded pedestal chair base described above, the hub can be additionally strengthened by adding a reinforcing annulus to the bottom of the hub, either as part of the molding or as a separate element attached later. If molded, then obviously the annulus composition matches that of the other molded elements. If attached later, then the annulus is comprised of a material or composite that has a yield strength of at least 25,000 psi, more preferably at least 30,000 psi, and most preferably at least 40,000 psi. If the material or composite has a higher ultimate or tensile strength, then an ultimate strength of at least 30,000 psi is preferred, more preferably at least 40,000 psi, and most preferably at least 50,000 psi. The reinforcing annulus can be dimensioned and configured to have an opening that is concentric with the hub opening, to have a width of between ¼ inch and 2 inches, and to have a thickness of at least 3/16 inch, preferably between ¼ inch and ½ inch. The outer diameter of the annulus can extend beyond the outside diameter of the hub so as to provide an outside shoulder, typically extending from ½ inch to 2½ inches. Moreover, the annulus can be dimensioned and configured to be concentric with the axis of the hub opening and be attached to each of the legs. For example, the annulus can have a have a width of between ¼ inch and 2 inches, to have an outside diameter of between 3 inches and 12 inches, and to have a thickness of at least 3/16 inch, preferably between ¼ inch and ½ inch.

With respect to the above preferred molded embodiments, the sectional modulus of the hub, each leg, and each caster attachment means are such that the pedestal chair base, as a whole, can withstand the torsional loads, shear forces, compression forces, and tension forces, with sufficient fatigue resistance, so as to pass BIFMA test No. 8 with a 5000 lb load being applied, instead of a 2500 lb load, and so as to pass BIFMA tests No. 9 and No. 18, each with a 500 lb load being used instead of a 300 lb load.

All publications or unpublished patent applications mentioned herein are hereby incorporated by reference thereto.

Other embodiments of the present invention are not presented here which are obvious to those of skill in the art, now or during the term of any patent issuing herefrom, and thus, are within the spirit and scope of the present invention.

I claim:

1. A pedestal base for a chair capable of safely supporting up to a 500 pound person comprising:

a) a substantially cylindrical hub made of a material or composite having an yield strength of at least 20,000 psi at 68 degrees Fahrenheit, said hub having an opening dimensioned and configured to receive either a means for controlling the position of a seat or a means for supporting a seat to a pedestal base, and said hub having a wall thickness about the opening of from about ⅛ inch to ½ inch;

b) six legs radiating from the hub, each leg being separated from its neighboring legs by about 60 degrees, each leg being made of a material or composite having a yield strength of at least 20,000 psi at 68 degrees Fahrenheit, the proximal end of each leg being welded to the hub, each leg having a cross-sectional configuration selected from the group of substantially polygonal bar, H bar, I bar, or U channel, and each leg having a length of about 12 inches to 14 inches, a width of less than 2 inches, and a height of from about 1 inch to 3 inches; and c) six means for attaching a caster to a leg, each such means being made of a material or composite having a yield strength of at least 20,000 psi at 68 degrees Fahrenheit, each such means being dimensioned and configured to receive or to be received by a caster or a glide, each such means being attached to one of the legs at the distal end away from the hub; and each such means having a wall thickness about the opening of from about ⅛ inch to ½ inch;

wherein the sectional modulus of the hub, each leg, and each caster attachment means are dimensioned and configured such that the pedestal chair base as a whole can pass BIFMA test No. 8 with a 5000 lb. load being applied, instead of a 2500 lb. load, and can pass BIFMA tests No. 9 and No. 18, each with a 500 lb. load being used instead of a 300 lb. load.

2. The pedestal chair base of claim 1 wherein:

a) each caster attachment means is selected from the group consisting of nibs and stems, and if a nib, has an opening being dimensioned and configured to receive a caster or a glide, each nib being attached to one of the legs at the distal end away from the hub such that the axis of the nib opening is parallel to the axis defined by the hub opening, or if a stem, has an shaft dimensioned and configured to be received by a conventional caster or a glide, each stem being oriented such that the axis of the stem shaft is parallel to the axis of the hub opening; and b) a caster or glide is attached to each caster attachment means, said caster being dimensioned and configured to withstand a working load of no greater than 80 lbs and a rolling load of no greater than 95 lbs.

3. The pedestal chair base of claim 2 said caster is dimensioned and configured to withstand a working load of at least 165 lbs and a rolling load of no greater than 80 lbs.

4. The pedestal chair base of claim 2 wherein the caster has a rolling diameter of at least 1 inch.

5. The pedestal chair base of claim 4 wherein the caster has a rolling diameter of at least 2 inches.

6. The pedestal chair base of claim 1 wherein the hub, the legs, and the caster attachment means have a yield strength of at least 25,000 psi.

7. The pedestal chair base of claim 6 wherein suitable materials or composites for the hub, the legs, and the caster attachment means include casting metals or alloys, plastic casting or molding resins or composites, weldable metals or alloys.

8. The pedestal chair base of claim 7 wherein the casting metals or alloys include aluminum, aluminum alloys, iron, steel, steel alloys, or bronze.

9. The pedestal chair base of claim 7 wherein the weldable metals or alloys include low carbon steels, medium carbon steels, high carbon steels, aluminum, or stainless steels.

10. The pedestal chair base of claim 6 wherein a caster or glide means is attached to each caster attachment means, said caster means being dimensioned and configured to withstand a working load of at least 150 lbs and a rolling load of no greater than 95 lbs.

11. The pedestal chair base of claim 10 wherein the caster is dimensioned and configured to withstand a working load of at least 165 lbs and a rolling load of no greater than 80 lbs.

12. The pedestal chair base of claim 11 wherein the caster has a rolling diameter of at least 1 inch.

13. The pedestal chair base of claim 12 wherein the caster has a rolling diameter of at least 2 inches.

14. The pedestal chair base of claim 6 wherein the hub, the legs, and the caster attachment means have a yield strength of at least 30,000 psi.

15. The pedestal chair base of claim 14, wherein the legs have a length of from 10 inches to 14 inches, a width of less than 2 inches, and a height of from 1 inch to 2½ inches.

16. The pedestal chair base of claim 14 wherein the hub has a wall thickness about the opening of from about ⅛ inch to ½ inch.

17. The pedestal chair base of claim 16 wherein the caster attachment means has a wall thickness about the opening of from about ⅛ inch to ½ inch.

18. The pedestal chair base of claim 14 wherein a caster or glide means is attached to each caster attachment means, said caster means being dimensioned and configured to withstand a working load of of at least 150 lbs and a rolling load of no greater than 95 lbs.

19. The pedestal chair base of claim 19 wherein the caster is dimensioned and configured to withstand a working load of at least 165 lbs and a rolling load of no greater than 80 lbs.

20. The pedestal chair base of claim 19 wherein the caster has a rolling diameter of at least 1 inch.

21. The pedestal chair base of claim 20 wherein the caster has a rolling diameter of at least 2 inches.

22. The pedestal chair base of claim 14 wherein the hub, the legs, and the caster attachment means have a yield strength of at least 40,000 psi.

23. The pedestal chair base of claim 22 wherein the legs have a length of from 10 inches to 14 inches, a width of less than 2 inches, and a height of from 1 inch to 2½ inches.

24. The pedestal chair base of claim 22 wherein the hub has a wall thickness about the opening of from about ⅛ inch to ½ inch.

25. The pedestal chair base of claim 24 wherein the caster attachment means has a wall thickness about the opening of from about ⅛ inch to ½ inch.

26. The pedestal chair base of claim 22 wherein a caster or glide means is attached to each caster attachment means, said caster means being dimensioned and configured to withstand a working load of at least 150 lbs and a rolling load of no greater than 95 lbs.

27. The pedestal chair base of claim 26 wherein the caster is dimensioned and configured to withstand a working load of at least 165 lbs and a rolling load of no greater than 80 lbs.

28. The pedestal chair base of claim 27 wherein the caster has a rolling diameter of at least 1 inch.

29. The pedestal chair base of claim 28 wherein the caster means has a rolling diameter of at least 2 inches.

* * * * *